United States Patent [19]

Otani

[11] 4,177,370

[45] Dec. 4, 1979

[54] VARIABLE COOKING MODE SELECTOR IN A MICROWAVE OVEN

[75] Inventor: Akira Otani, Yamatokoriyama, Japan

[73] Assignee: Sharp Kabushiki Kaisha, Osaka, Japan

[21] Appl. No.: 909,569

[22] Filed: May 25, 1978

Related U.S. Application Data

[63] Continuation of Ser. No. 767,149, Feb. 9, 1977, abandoned.

[30] Foreign Application Priority Data

Feb. 13, 1976 [JP] Japan ..... 51/15353
Feb. 13, 1976 [JP] Japan ..... 51/15354

[51] Int. Cl.[2] ..... H05B 9/06

[52] U.S. Cl. ..... 219/10.55 B; 200/38 FA; 219/10.55 C

[58] Field of Search ..... 219/10.55 B, 10.55 R, 219/10.55 C; 200/38 R, 38 B, 38 BA, 38 C, 38 CA, 38 FA, 31 R, 30 R, 33 B, 27 R, 27 B

[56] References Cited

U.S. PATENT DOCUMENTS

| | | | |
|---|---|---|---|
| 2,578,632 | 12/1951 | Miller | 200/31 R |
| 2,633,914 | 4/1953 | Miller | 219/29 |
| 3,824,365 | 7/1974 | Tapper | 219/10.55 B |
| 4,028,517 | 6/1977 | Tanaka et al. | 219/10.55 B |

FOREIGN PATENT DOCUMENTS

| | | | |
|---|---|---|---|
| 210558 | 1/1967 | Sweden | 219/10.55 B |
| 1323551 | 7/1973 | United Kingdom | 219/10.55 B |

*Primary Examiner*—Arthur T. Grimley
*Attorney, Agent, or Firm*—Birch, Stewart, Kolasch and Birch

[57] ABSTRACT

A control cam plate having a periphery divided into four sections of different radiuses is driven to rotate by a cam motor mounted on a supporting table. The supporting table is rotatably secured in a microwave oven, and one end of the supporting table is fixed to a manually operable selection lever for shifting the location of the control cam plate. A switching means is associated with the control cam plate for controlling a repetition rate of a power supply to a magnetron employed in the microwave oven in response to slide operation of the manually operable selection lever. In a preferred form, a menu drum is provided in such a manner as to rotate in response to the slide operation of the manually operable selection lever, thereby facilitating recognition of cooking modes.

14 Claims, 7 Drawing Figures

VARIABLE COOKING MODE SELECTOR IN A MICROWAVE OVEN

This is a continuation of copending application Ser. No. 767,149, filed on Feb. 9, 1977, now abandoned.

BACKGROUND AND SUMMARY OF THE INVENTION

The present invention relates to a microwave oven and, more particularly, to a variable cooking mode selector for controlling a magnetron output in a microwave oven.

A control system has been proposed, which intermittently enables a magnetron employed in a microwave oven for varying a mean output level in accordance with variations of a repetition rate of magnetron energization.

In a conventional control system of the prior art, a contactless switching system made of a semiconductor circuit, or a complicated cam mechanism is employed to perform the intermittent switching operation. However, either the contactless switching system or the cam mechanism of the prior art is so complicated that a simple control system is eagerly desired.

Accordingly, an object of the present invention is to provide a microwave oven, wherein a mean output level of a magnetron employed in the microwave oven is selectable at a desired value.

Another object of the present invention is to provide a variable cooking mode selector of a simple construction for varying a mean output level of a magnetron employed in a microwave oven.

Still another object of the present invention is to provide a switching assembly of a simple construction for intermittently energizing a magnetron employed in a microwave oven.

Yet another object of the present invention is to provide a menu drum associated with a variable cooking mode selector for indicating a selected cooking mode.

Other objects and further scope of applicability of the present invention will become apparent from the detailed description given hereinafter. It should be understood, however, that the detailed description and apecific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a control cam plate having a periphery divided into plural, for example, four sections of different radiuses is provided and is driven into rotation by a cam motor mounted on a supporting table. The supporting table is disposed in a microwave oven housing in such a manner as to rotate about a middle portion thereof. One end of the supporting table is fixed to a manually operable selection lever, and the cam motor is mounted on the other end portion of the supporting table, whereby the control cam plate location is shifted in response to slide operation of the manually operable selection lever.

A switching means is associated with the control cam plate for intermittently energizing a magnetron employed in the microwave oven in response to the rotation of the control cam plate. The repetition rate of the magnetron energization is controlled by shifting the control cam plate through the manually operable selection lever, whereby a mean output level of the magnetron is varied.

In a preferred form, a menu drum is provided in such a manner as to rotate in response to the slide operation of the manually operable selection lever. The menu drum has four side walls on which menus suited for a selected cooking mode, for example, a full power mode, a roast mode, a simmer mode and a defrost mode are indicated.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
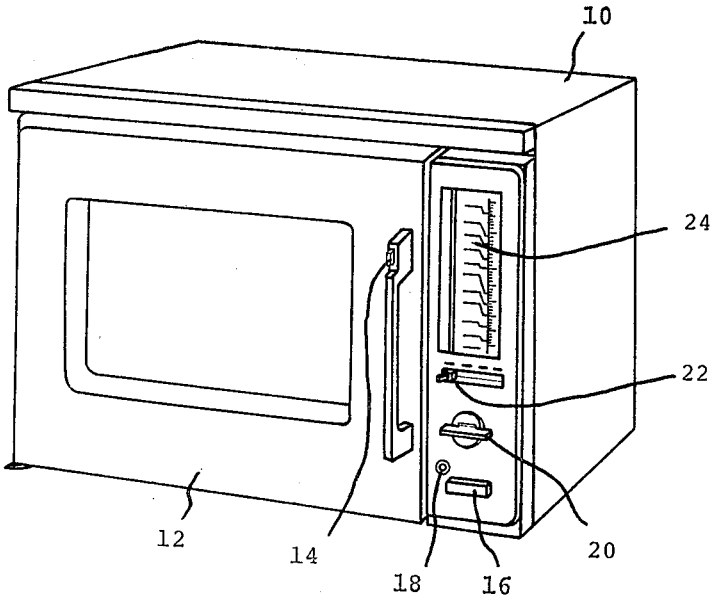
FIG. 1 is a perspective view of a microwave oven employing an embodiment of a variable cooking mode selector of the present invention.

FIG. 1 shows a microwave oven employing an embodiment of a variable cooking mode selector of the present invention.

A microwave oven housing 10 includes an oven door 12 which is tightly closed during cooking operation by a latch mechanism associated with a latch button 14. A control panel is positioned at the right side of the front wall of the microwave oven housing 10, which includes a cook switch button 16, a cook lamp 18 for indicating that the microwave oven is in the cooking operation, a timer knob 20 coupled to a timer arrangement for determining a cooking operation time period, a manually operable selection lever 22 coupled to a variable cooking mode selector of the present invention, and a menu drum 24 for indicating menues suited for a selected cooking mode.

Figure 2:
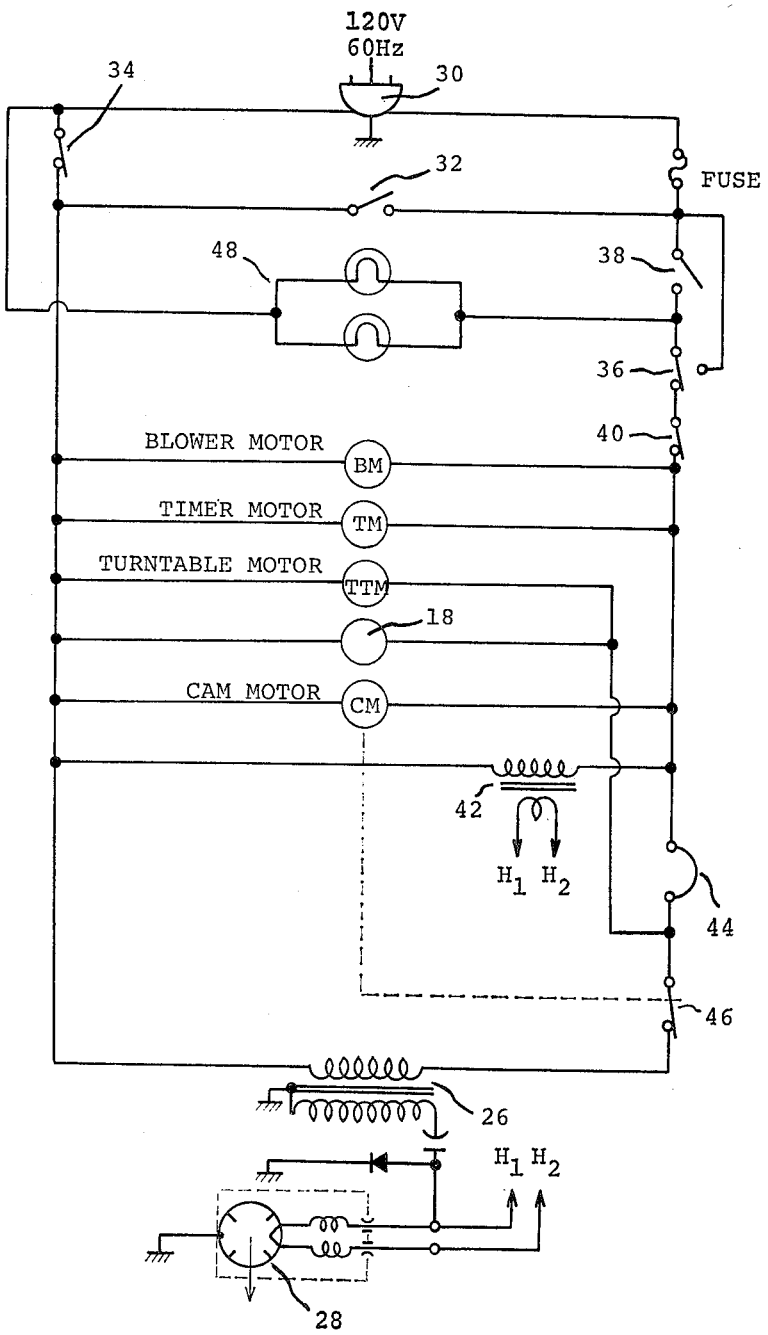
FIG. 2 is a circuit diagram of the microwave oven of FIG. 1.

FIG. 2 shows a circuit construction of a microwave oven including a magnetron drive circuit associated with the variable cooking mode selector of the present invention. The circuit mainly comprises a power supply side connected to a primary winding of a high voltage transformer 26 and a microwave generation side including a magnetron 28 connected to a secondary winding of the high voltage transformer 26.

The power supply side includes a commercial power source 30, and a monitor switch 32 which is mechanically placed in its OFF condition when the oven door is closed and is mechanically placed in its ON condition when the oven door is opened. The power supply side further includes a primary interlock switch 34 and a secondary interlock switch 36, which are mechanically placed in the ON condition when the oven door is closed and are mechanically placed in the OFF condition when the oven door is opened through the use of the latch mechanism. That is, the interlock switches 34 and 36 function to allow the power supply to the remaining portions of the circuit only when the oven door is tightly closed.

Figures 3, 4:
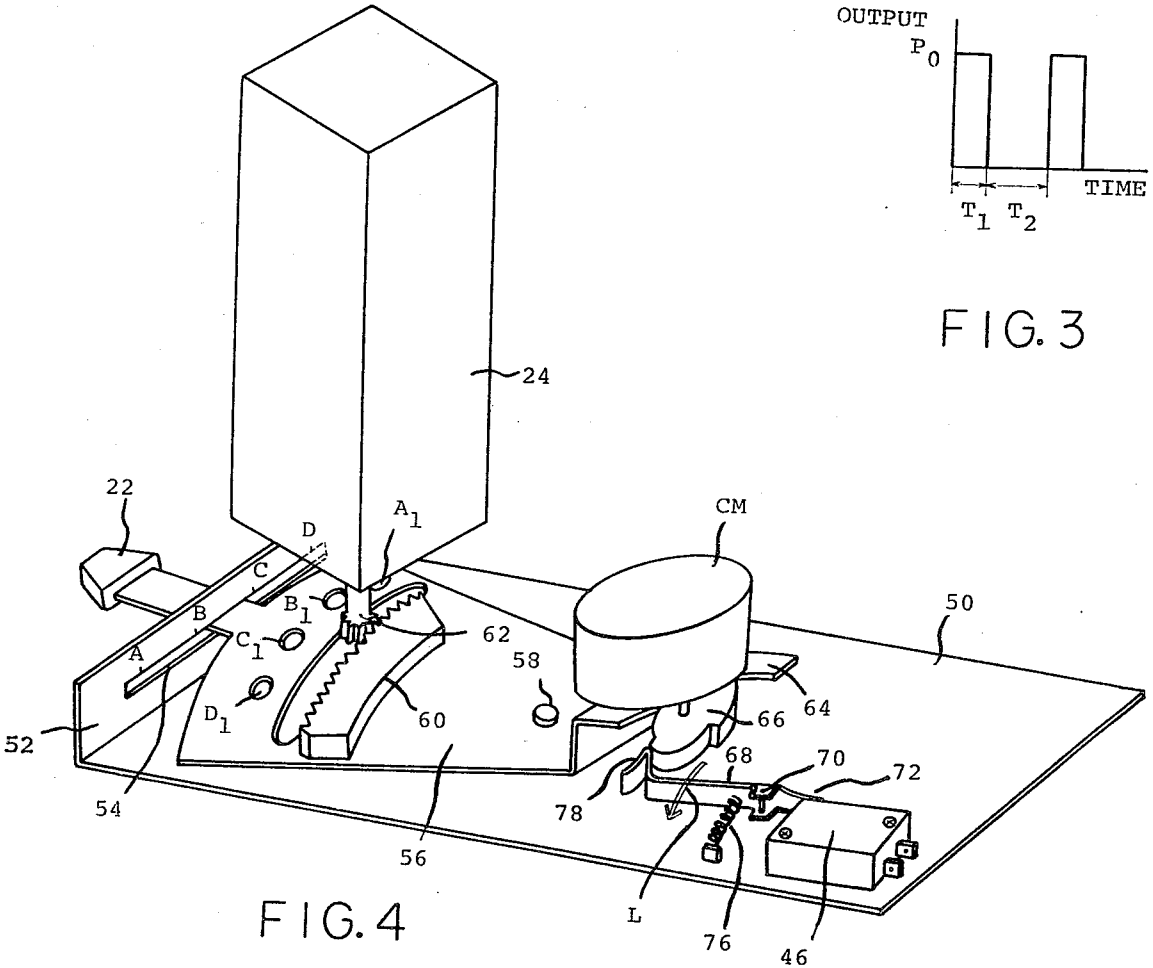
FIG. 3 is a time chart for explaining operation of the circuit shown in FIG. 2.
FIG. 4 is a perspective view of an embodiment of the variable cooking mode selector of the present invention.

When the timer is set at a desired value through the use of the timer knob 20, a timer contact 38 is mechanically closed. Under these conditions, when a cook switch 40 associated with the cook switch button 16 is closed, a blower motor BM, a timer motor TM, a cam motor CM, a heater transformer 42, and a thermo cut-out 44 are enabled. A secondary winding of the heater transformer 42 is connected to a filament of the magnetron 28 to heat it. The thermo cut-out 44 is usually in the closed condition and is opened when an abnormally high temperature is detected, thereby protecting the magnetron 28 from being damaged. A turntable motor TTM and the cook lamp 18 are enabled through the thermo cut-out 44. A control switch 46 is intermittently closed in response to the rotation of the cam motor CM. The relationship between the cam motor rotation and the intermittent closing operation of the control switch 46 will be described later. It will be clear that the magnetron 28 is energized only when the control switch 46 is closed. In FIG. 2, a reference number 48 represents an oven light for illuminating the interior of the microwave oven cavity. A mean output level of the magnetron 28 varies in accordance with a repetition rate of the closing and opening of the control switch 46. Now assume that the control switch 46 is closed during a time period $T_1$, whereby the magnetron 28 develops microwave energy of an output level $P_0$, and the control switch 46 is open during another period $T_2$ as shown in FIG. 3. When this cycle is repeated, the mean output level of the magnetron 28 can be calculated as follows:

$$P=P_0\times[T_1/(T_1+T_2)] \text{ (watts)}$$

FIG. 4 shows an embodiment of the variable cooking mode selector of the present invention, which functions to vary the repetition rate of the magnetron energization.

A supporting frame 50 includes a bent portion 52 having an aperture 54. A supporting table 56 is secured on the supporting frame 50 in such a manner as to rotate about a shaft 58. One end of the supporting table 56 is extruded outward through the aperture 54, to which the manually operable selection lever 22 is fixed. Therefore, the supporting table 56 is rotated about the shaft 58 in response to slide operation of the manually operable selection lever 22 along the aperture 54. Four holes $A_1$, $B_1$, $C_1$ and $D_1$ are formed in the supporting table 56, which secure a ball (not shown) rotatably mounted on the supporting frame 50, thereby temporarily fixing the location of the manually operable selection lever 22, or, the rotation angle of the supporting table 56 at any desired point selected from four points A, B, C and D.

A rack 60 is fixed to the supporting table 56, which is associated with a gear 62 fixed to a shaft of the menu drum 24. The menu drum 24 is rotated about the shaft in such a manner that one of four walls thereof is faced outside when the manually operable selection lever 22 is temporarily held at one of the points A, B, C and D. Menus suited for the selected points A, B, C and D are indicated on the corresponding walls of the menu drum 24.

The other end of the supporting table 56 is bent to form a bed 64 for supporting the cam motor CM. A control cam plate 66 is fixed to a shaft of the cam motor CM so as to rotate in unison with cam motor revolution. The control switch 46 is mounted on the supporting frame 50. An actuator lever 68 is provided for intermittently closing the control switch 46 is response to the revolution of the control cam plate 66. The actuator lever 68 is rotatable about a shaft 70 fixed to the supporting frame 50. One end 72 of the actuator lever 68 is forced to come into contact with an actuator 74 (see FIG. 5) of the control switch 46 by a spring 76, and the other end 78 of the actuator lever 68 is associated with a periphery of the control cam plate 66.

Figure 5:
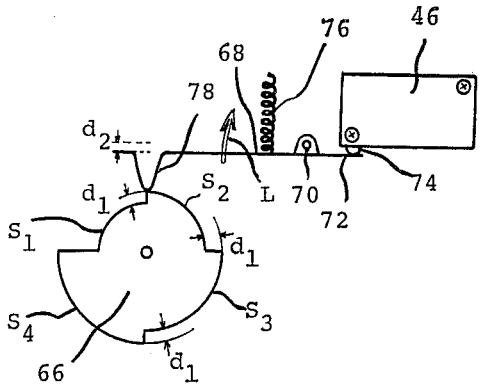
FIG. 5 is a plan view of a control cam plate and a switching assembly employed in the variable cooking mode selector of FIG. 4.

FIG. 5 shows a relationship between the control cam plate 66 and the actuator lever 68. Like elements corresponding to those of FIG. 4 are indicated by like numerals.

The control cam plate 66 has a periphery divided into four sections $S_1$, $S_2$, $S_3$ and $S_4$ of different radiuses. More particularly, each section of $S_1$, $S_2$, $S_3$ and $S_4$ has a central angle of 90°, the radius of the section $S_2$ is greater than that of the section $S_1$ by $d_1$, the radius of the section $S_3$ is greater than that of the section $S_2$ by $d_1$, and the radius of the section $S_4$ is greater than that of the section $S_3$ by $d_1$.

Now remember that the location of the control cam plate 66 is shifted in response to the slide operation of the manually operable selection lever 22. Therefore, the repetition rate of the closing of the control switch 46 is varied through the use of the manually operable selection lever 22.

When the manually operable selection lever 22 is positioned at the point A, none of the sections $S_1$ through $S_4$ becomes contact with the end 78 of the actuator lever 68 during the revolution of the control cam plate 66. Therefore, the control switch 46 is continuously closed to continuously energize the magnetron 28. That is, the cooking is performed in the full power mode as shown by the reference A in FIG. 6.

When the manually operable selection lever 22 is positioned at the point B, only the section $S_4$ is brought into contact with the end 78 of the actuator lever 68 during the revolution of the control cam plate 66. When the section $S_4$ becomes contact with the end 78 of the actuator lever 68, the actuator lever 68 is forced to rotate, against the spring force, in the direction shown by an arrow L. The control switch 46 is open and, therefore, the magnetron 28 is not energized, while the section $S_4$ is brought into contact with the end 78 of the actuator lever 68. The mean output level of the magnetron 28 is 75% of the full power as shown by the reference B in FIG. 6. This is called "Roast" mode.

Figure 6:
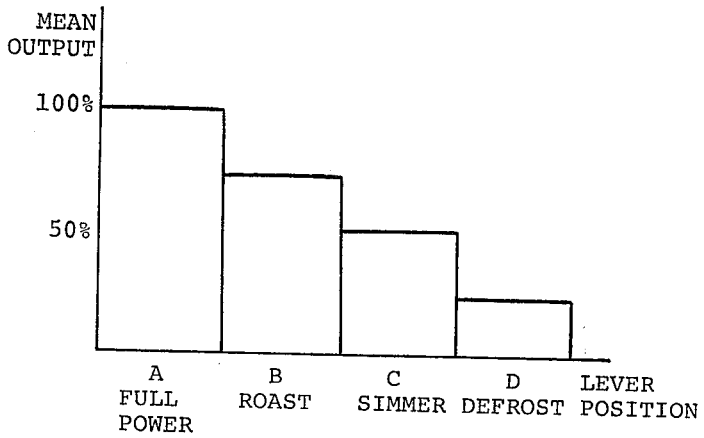
FIG. 6 is a time chart for explaining operation of the variable cooking mode selector of the present invention.

In a same manner, the mean output level of the magnetron 28 is 50% of the full power when the manually operable selection lever 22 is positioned at the point C. This is the "Simmer" mode. When the manually operable selection lever 22 is positioned at the point D, the sections $S_2$, $S_3$ and $S_4$ are brought into contact with the end 78 of the actuator lever 68 during the rotation of the control cam plate 66. Therefore, the mean output lever is 25% of the full power, and this is called "Defrost" mode. Respective mean output levels are shown in FIG. 6.

The above mentioned difference $d_1$ of the radiuses of the respective sections $S_1$ though $S_4$ should be greater than the minimum shift length $d_2$ required for activating the actuator 74 of the control switch 46.

Figure 7:
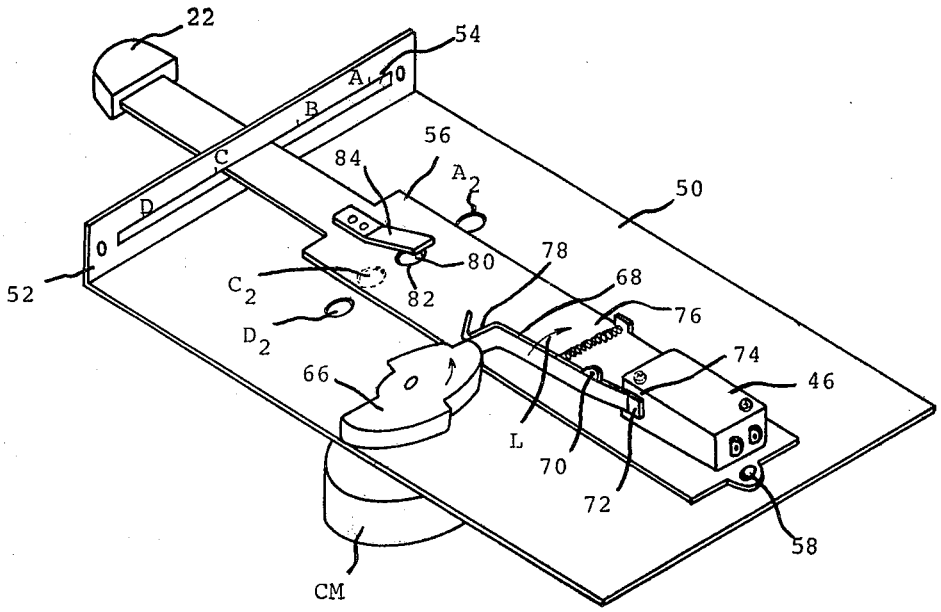
FIG. 7 is a perspective view of another embodiment of the variable cooking mode selector of the present invention.

FIG. 7 shows another embodiment of the variable cooking mode selector of the present invention. Like elements corresponding to those of FIG. 4 are indicated by like numerals.

In this embodiment, the supporting table 56 is rotatable about the shaft 58 positioned at one end of the supporting table 56. The control switch 46 and the actuator lever 68 are mounted on the supporting table 56, and the cam motor CM is supported by the supporting frame 50. A ball 80 is secured in a hole 82 formed in the supporting table 56. Four holes $A_2$, $B_2$, $C_2$ and $D_2$ are formed in the supporting frame 50. A depressing plate 84 functions to depress the ball 80 downward, whereby the ball 80 is engaged in any one of the holes $A_2$ through $D_2$ to temporarily hold the manually operable selection lever 22 at a desired point selected from A through D. Remaining operation is similar to that of the embodiment of FIG. 4 and, therefore, it has been omitted for the purpose of simplicity.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A variable cooking mode selector for a microwave oven comprising:

a first supporting means disposed in a microwave oven housing;

a second supporting means movably mounted on the first supporting means;

a cam motor mounted on the second supporting means;

a cam plate fixed to a cam motor shaft of said cam motor, the cam plate having a periphery divided into plural sections of different radiuses, each of said sections providing a different repetition rate of energization of a magnetron employed in said microwave oven;

a switching means mounted on the first supporting means, said switching means functioning to energize a magnetron employed in the microwave oven;

an actuator lever associated with said switching means for closing or opening said switching means in response to the revolution of a selected section of said cam plate; and control means fixed to said second supporting means for selecting the section of said cam plate which controls said actuator lever;

whereby a repetition rate of the magnetron energization is varied through the use of said control means to implement selected cooking modes.

2. The variable cooking mode selector of claim 1 wherein said second supporting means is pivotally mounted on said first supporting means.

3. The variable cooking mode selector of claim 1 wherein said actuator lever is pivotally mounted on said first supporting means.

4. The variable cooking mode selector of claim 1, wherein said switching means is normally closed and is opened when said selected section of said cam plate engages said actuator lever.

5. The variable cooking mode selector of claim 1, which further comprises indicator means associated with said second supporting means for indicating the cooking mode selected by said control means.

6. The variable cooking mode selector of claim 1, wherein said control means includes means for shifting the position of said second supporting means with respect to said first supporting means to selectively vary the distance between said cam plate and said actuator lever.

7. A variable cooking mode selector for a microwave oven comprising:

a first supporting means disposed in a microwave oven housing;

a second supporting means movably mounted on the first supporting means;

a cam motor mounted on the first supporting means;

a cam plate fixed to a cam motor shaft of said cam motor, a cam plate having a periphery divided into plural sections of different radiuses, each of said sections providing a different repetition rate of energization of a magnetron employed in said microwave oven;

a switching means mounted on the second supporting means, said switching means functioning to energize a magnetron employed in the microwave oven;

an actuator lever associated with said switching means for closing or opening said switching means in response to the revolution of a selected section of said cam plate; and control means fixed to said second supporting means for selecting the section of said cam plate which controls said actuator lever;

whereby a repetition rate of the magnetron energization is varied through the use of said control means to implement selected cooking modes.

8. The variable cooking mode selector of claim 7, wherein said second supporting means is pivotally mounted on said first supporting means.

9. The variable cooking mode selector of claim 7 or 8 wherein said actuator lever is pivotally mounted on said first supporting means.

10. The variable cooking mode selector of claim 7, wherein said switching means is normally closed and is opened when said selected section of said cam plate engages said actuator lever.

11. The variable cooking mode selector of claim 7, which further comprises indicator means associated with said second supporting means for indicating the cooking mode selected by said control means.

12. The variable cooking mode selector of claim 7, wherein said control means includes means for shifting the position of said second supporting means with respect to said first supporting means to selectively vary the distance between said cam plate and said actuator level.

13. A variable cooking mode selector for a microwave oven comprising:

a control cam plate;

a control switch for energizing a magnetron employed in the microwave oven;

actuator means for closing the control switch in response to the revolution of the control cam plate;

shift means for varying the distance between the control cam plate and the actuator means, whereby the repetition rate of the energization of the magnetron is varied in response to the variation of the distance between the control cam plate and the actuator means; and a menu drum which rotates in unison with the movement of said shift means for indicating the cooking mode selected by said shift means.

14. The variable cooking mode selector of claim 13, wherein siad control cam plate has the periphery thereof divided into plural sections of different radiuses and said shifting means causes said actuator means to selectively engage said sections of different radiuses.

* * * * *